US006840507B2

(12) United States Patent
Brown

(10) Patent No.: US 6,840,507 B2
(45) Date of Patent: Jan. 11, 2005

(54) REPLACEMENT FENCE POST AND FENCE INSTALLATION

(76) Inventor: Dennis D. Brown, 1863 Alburn Pl., El Dorado Hills, CA (US) 95762

( * ) Notice: Subject to any disclaimer, the term of this patent is extended or adjusted under 35 U.S.C. 154(b) by 142 days.

(21) Appl. No.: 10/124,574

(22) Filed: Apr. 17, 2002

(65) Prior Publication Data

US 2003/0197161 A1 Oct. 23, 2003

(51) Int. Cl.[7] ..... E04H 17/20
(52) U.S. Cl. ..... 256/65.01; 256/65.14
(58) Field of Search ..... 256/1, 19, 24, 256/26, 29–31, 50–58, 65.01, 65.02, 65.07, 65.13, 65.14–65.16, 68, 69, DIG. 5, DIG. 6; 52/170, 262, 288.1, 655.1; 248/156, 530, 545

(56) References Cited

U.S. PATENT DOCUMENTS

| | | | | | |
|---|---|---|---|---|---|
| 221,449 | A | * | 11/1879 | Wolfe | 52/165 |
| 342,922 | A | * | 6/1886 | Munn | 256/55 |
| 597,684 | A | * | 1/1898 | Marsch | 256/24 |
| 786,568 | A | * | 4/1905 | Johnson | 256/57 |
| 852,421 | A | * | 5/1907 | Davis | 256/47 |
| 1,189,025 | A | * | 6/1916 | Wiernasz | 256/31 |
| 1,496,665 | A | * | 6/1924 | Fahrenholz | 256/52 |
| 1,788,096 | A | * | 1/1931 | Friedemann | 108/96 |
| 2,039,879 | A | * | 5/1936 | Brown et al. | 256/68 |
| 3,711,974 | A | * | 1/1973 | Webb | 40/607.11 |
| 3,814,416 | A | * | 6/1974 | Munger et al. | 482/36 |
| 3,893,776 | A | * | 7/1975 | Beattie | 403/259 |
| 4,070,006 | A | * | 1/1978 | Storie | 256/1 |
| 4,477,058 | A | * | 10/1984 | Lowery | 256/19 |
| 4,843,746 | A | * | 7/1989 | DesNoyers et al. | 40/607.04 |
| 4,892,292 | A | * | 1/1990 | Russell | 256/66 |
| 4,930,754 | A | * | 6/1990 | Caron et al. | 256/65.05 |
| 4,953,830 | A | * | 9/1990 | Weaver, III | 256/65.02 |
| 5,601,279 | A | * | 2/1997 | Schwartz et al. | 256/66 |
| 5,636,482 | A | * | 6/1997 | Klager | 52/165 |
| 5,695,174 | A | * | 12/1997 | Tsai | 256/22 |
| 5,755,431 | A | * | 5/1998 | Williams | 256/19 |
| 6,401,408 | B1 | * | 6/2002 | Schwartz et al. | 52/155 |

FOREIGN PATENT DOCUMENTS

| | | | | |
|---|---|---|---|---|
| DE | 40 02 830 A1 | * | 9/1990 | 256/19 |
| FR | 2 571 771 A1 | * | 4/1986 | 256/19 |

* cited by examiner

*Primary Examiner*—James R. Brittain
(74) *Attorney, Agent, or Firm*—Mark C. Jacobs

(57) ABSTRACT

A fence post system that permits the attachment of conventional fencing sections is recited. The pole of this post system is preferably a square tube having a trio of vertically spaced bore sets, each bore within the set having a threaded connector disposed therein. A notched insert sized to fit inside the pole and having an elevation of no greater than about 18 inches is set into a hole, the pole disposed over it, the proper elevation determined, followed by attachment of the tube to the insert, with the tube elevated from the bottom of the excavation. The tube is retained vertically, concrete poured into the excavation and permitted to harden around the insert and the elevated tube. Slab side members are bolted to the connectors on at least two of the sides of the pole such that a fencing section can be attached conventionally to each slab side member.

21 Claims, 5 Drawing Sheets

REPLACEMENT FENCE POST AND FENCE INSTALLATION

FIELD OF THE INVENTION

This invention relates to a new type of fence post and its installation as a replacement for rotted redwood fence posts. The invention also relates to the mode of attachment of fencing to the fence post.

Definitions

The term fence post, as used herein, is intended to mean a single member of wood or metal inserted vertically into the ground and being sized at about 3 by 3 inches or larger. The post of this invention is a tubular pole, preferably made of steel or aluminum alloy.

The term wood fencing, herein, refers to a plurality of wood members usually about 6 feet (pickets) long utilized vertically and attached to 2 by 4 inch boards spaced apart and spaced up from the ground directed horizontally.

An assemblage of a plurality of pickets to the cross members (horizontal members) often of about 4 to 6 feet in span is referred to as fence or fencing sections.

A "good neighbor" fence is a fence wherein alternate sections of fencing have the cross members facing the viewer. In a standard fence, only the pickets are seen from one side of the fence and all cross members are seen from the other side of the fence.

While the term connectors will be used herein, the connectors are technically referred to as threaded inserts for fasteners such as bolts, and are made by several manufacturers.

The post system of this invention refers to the combination of the tubular pole, the special connectors for the mounting of the slab side members and the fasteners to do so, further including the insert upon which the pole is disposed.

BACKGROUND OF THE INVENTION

Every adult living in the Western United States is quite familiar with the problem of fence post degradation. Whether the post rots out in the ground or rots due to age, even if set in concrete or is sheared off as a result of high wind, people know that sooner or later the fence posts will need to be replaced. Even if the fencing sections or individual pickets can be saved and reused, posts, for the most part, need to be replaced over time.

In California, many homeowners' insurance companies don't even bother sending out an adjuster after a major storm. They ask the property owner how many fencing sections are down, apply a formula for pricing and send out a check, as fencing and fence post replacement is a common hazard they incur.

The usual procedure for the replacement of redwood fence posts is to move away the downed fencing. That is, separate it—if not already separated, from the post remnant, and spend time digging out the concrete ball surrounding the base of the downed post, to leave an excavation for a new batch of concrete.

Applicant decided that there had to be a better fence post, an easier way to install the post, and an easier way to attach or reattach the fencing sections to the new post. This invention addresses all of these issues; namely, an improved fence post system, a new way to set up the pole forming part of the invention, and a new mode of attaching the fencing section to the newly installed post.

The invention accordingly comprises the device possessing the features, properties, the selection of components which are amplified in the following detailed disclosure, and the scope of the application of which will be indicated in the appended claims.

For a fuller understanding of the nature and objects of the invention, reference should be made to the following detailed description, taken in conjunction with the accompanying drawings.

SUMMARY OF THE INVENTION

A new fence post system based upon a metal tubular fence pole having three series of bores therein for the receipt of special connectors via which slab side members are attached to the pole by fasteners is set forth. Also disclosed is a mode of mounting the hollow pole over an insert member that serves to shorten the installation time necessary to setup a vertical fence post.

The mode of setting up the post comprises setting the insert into an excavation, securing the pole disposed over the insert to the insert, and embedding the base of the pole and the exposed portion of the insert in concrete. The insert serves to stabilize the pole, now elevated above the base of the excavation, in a vertical position until the concrete hardens, the rigid insert is allowed to remain or decompose depending upon the material employed for it.

It is a first object to define a new fence post system.

It is a second object to provide a fence post system that utilizes a tubular metal pole with appendages to which fencing sections can be attached with fasteners.

It is a third object to provide a new way to secure the pole portion of the post system in a vertical orientation.

Other objects of the invention will in part be obvious and will in part appear hereinafter.

DESCRIPTION OF THE PREFERRED EMBODIMENT

Figure 1:
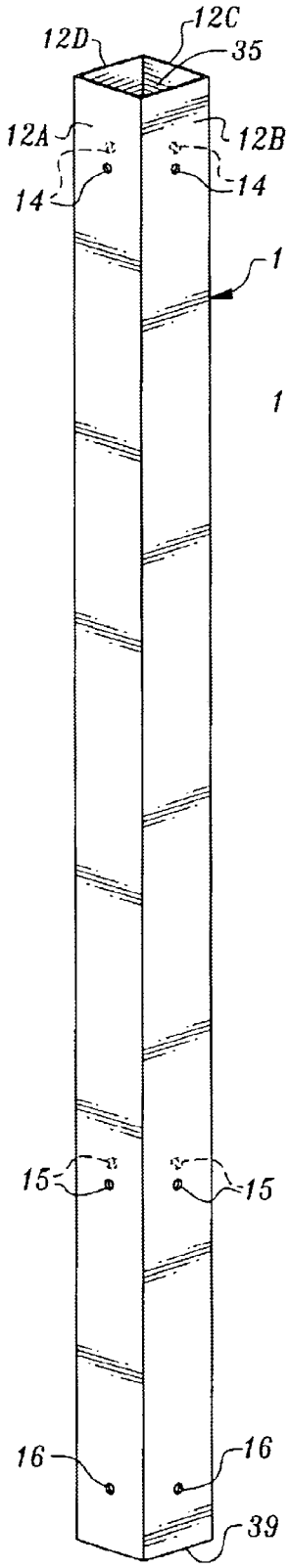
FIG. 1 is a front perspective view of the fence pole of this invention.

The fence post system 10 comprises a pole 11 as seen in FIG. 1. This pole is a preferably 3 by 3-inch square tubular member of about 6 to 8 ft tall. A round tube is also contemplated but is less preferred due to the difficulty that will arise in attaching slab side members thereto as is discussed elsewhere herein, Pole 11, has four faces 12A, 12B, 12C and 12D. All faces are to be bored to receive a connector as is described infra. Each pole 11 has three sets of bores, upper, middle and lower.

Figure 2:
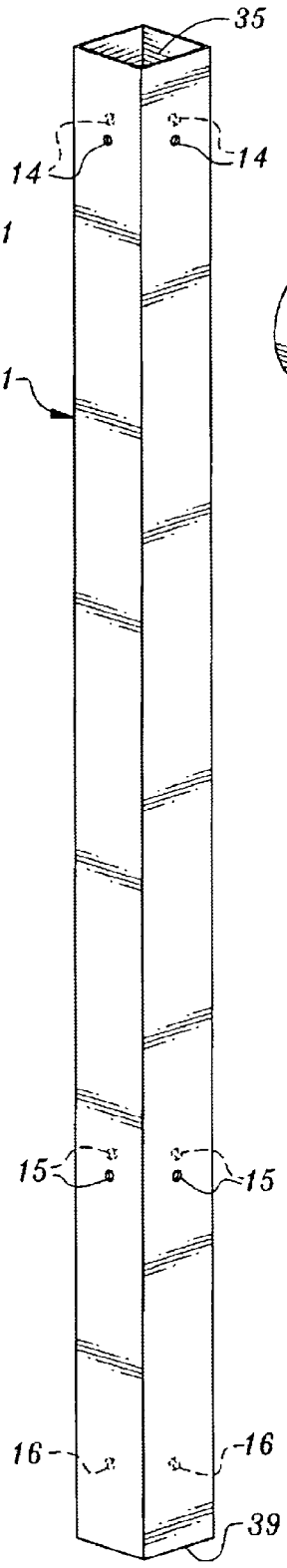
FIG. 2 is a rear perspective view of the fence pole of this invention.
Figure 3:
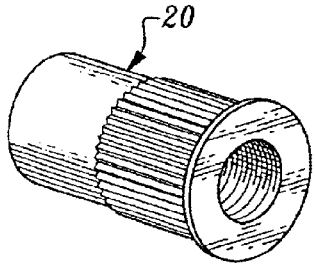
FIG. 3 is a perspective view of one of the connectors utilized in this invention.
Figure 4:
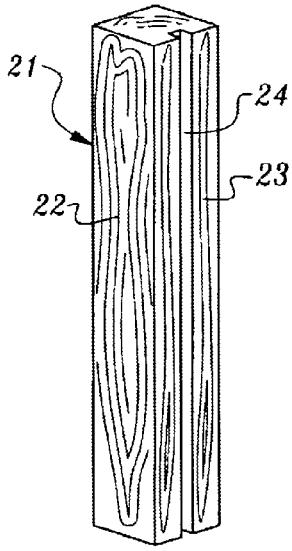
FIG. 4 is a front perspective view of the insert forming a part of this invention.
Figure 5:
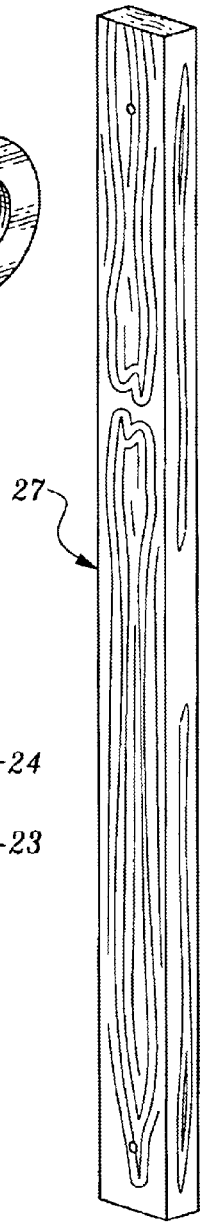
FIG. 5 is a perspective view of a side member forming a part of this invention used for attachment of fencing sections to the newly installed post.

At least one and up to a pair of spaced bores 14 are found on all four faces of the pole uniformly disposed slightly down from the top opening 35. Preferably only one bore is made on each of the four faces of the pole 11 as sufficient holding power can be achieved with one connection of the nature to be described. These bores are referred to as upper bores 14. See FIGS. 1 and 2. The bottom opening of the pole is designated 39 per FIG. 8 infra.

A second set of bores is also disposed at least one and no more than two on each face, in each of the four sides of the pole 11 at an elevation of preferably about 3 feet from said bottom opening 39. These "middle" bores are also disposed in a horizontal alignment spaced down from the upper set of four bores and spaced up more than 18 inches from the bottom of the pole for reasons to be recited later herein. This second set of bores is referred to as the middle bores.

Spaced down from the top and below the middle bores is a third set of bores; namely, the lower bores. While for ease of use in eliminating the issue of proper orientation of the pole, all four faces of the pole may be bored for the lower set. While the upper and middle sets had from 1–2 bores, the lower bore set requires only one bore 16 per face, preferably at the center line, to align with the notch of the insert as will be described elsewhere herein. Of these up to a total of four bores in the set, one per face, only one and at most a pair of bores will be used for attaching the pole to the insert as will be described below. The lower bores 16 are disposed within the pole about 1 inch from the bottom of the pole 11 as per FIG. 1.

A wooden or other solid material, such as MDF (medium density fiberboard) solid member designated 21, preferably square in configuration, as is needed to comply with the shape of the preferred pole, has on one side a notch 24 running vertically along the full length of the cut side 23. Each insert 21 is preferably about 18 inches in length, though shorter or longer ones fall within the scope of the invention, chamfering of the corners of the insert renders the mating engagement of the tube 11 with the insert easier to accomplish.

While four bores, at least one per face is suggested for each of the middle and upper sets of bores, only three such bores containing faces are actually needed. The fourth bore makes alignment issues go away as all faces of the post are employable in any position. It becomes a "no brainer" as to which direction any one face 12 is to be oriented.

Each of the bores present has a threaded connector 20 disposed therein. These threaded connectors are sold by AVK Industrial Products of Valencia, Calif. Installation is carried out by using the ARO Power Installation Tool also made by AVK Industrial Products.

In short, the threaded connector is placed in the bore where it is to be lodged. The tool's mandrel is placed into the connector to engage its internal threads. The tool is actuated and the connector is inserted fully into the bore. The tool is reversed, leaving the connector disposed in the bore. This procedure is known to the art, having been fully recited in even more detail in AVK Product literature. Once the connectors are fully disposed in their respective bore, part of the connector is on the inside and part of the connector is outside of the tubular member comprising the pole.

The insert 21 is sized on four sides slightly smaller than the inside diameter of the preferred 3 by 3-inch tube to ensure ease of entry of the tube 11 over the insert 21. See FIGS. 8 and 9.

Figure 12:
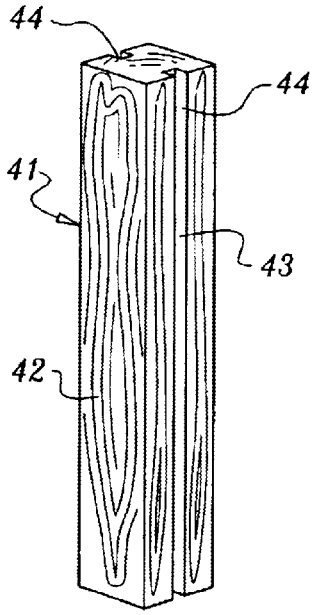
FIG. 12 is a top perspective view of a dual notch insert.

While in the case of the upper and middle sets of bores, a connector may be placed in all four, but preferably only three of the four bores are needed, care must be exercised to only fill one of the lower bores 16 with a connector in almost all instances. Only in the exceptional situation wherein the dual notch insert of FIG. 12 is used, two bores are to be loaded with connectors. The insert 21 is then placed into the bottom of the hole dug for the post, with its notched side 23 aligned with the face 12 of the post 11 that has the connector in a lower bore. See FIG. 8. By aligning the side of the insert 21 with the notch therein with the face of the post having the lower bore connector, when the post is disposed over the insert, the desired disposition can be accomplished as no impediment blocks the entry'since the portion of the connector that is inside the tube, clears the notch of the insert. Thus, theoretically the insert can be fully disposed within the tube, but, of course, it rarely is.

Figure 9:
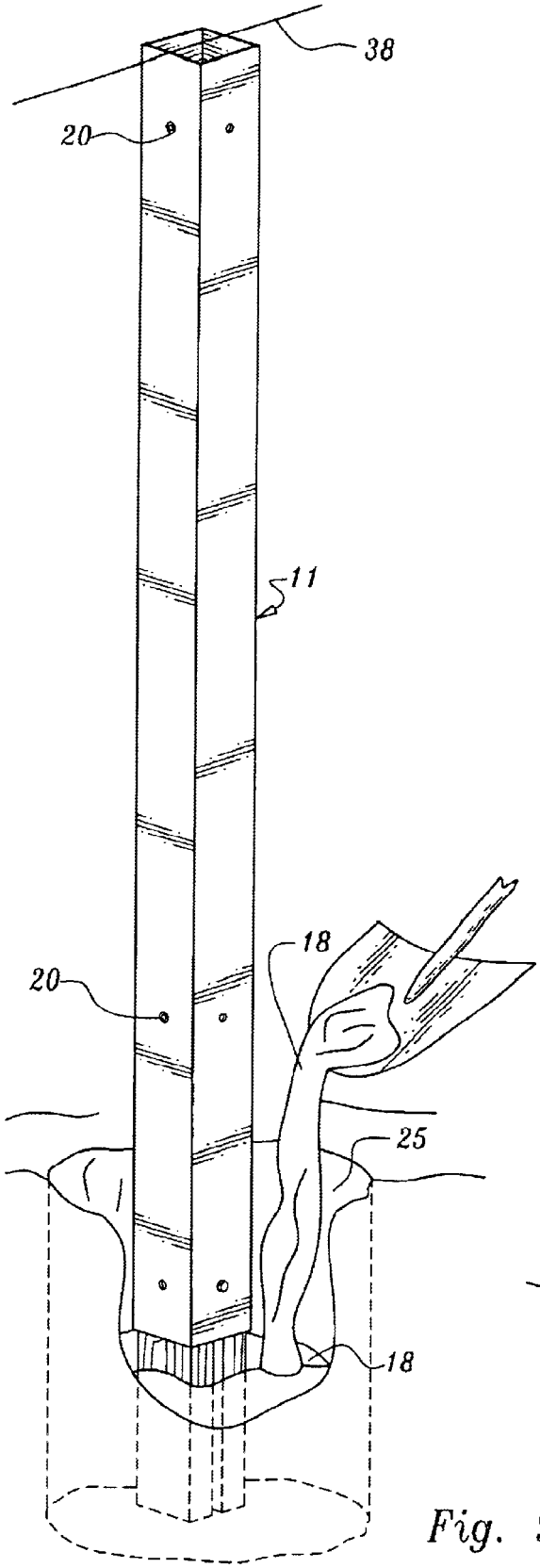
FIG. 9 is a perspective view of an insert disposed in an excavated hole with the pole disposed thereon, with the post at the desired elevation, and concrete being shoveled into the hole.
Figure 10:
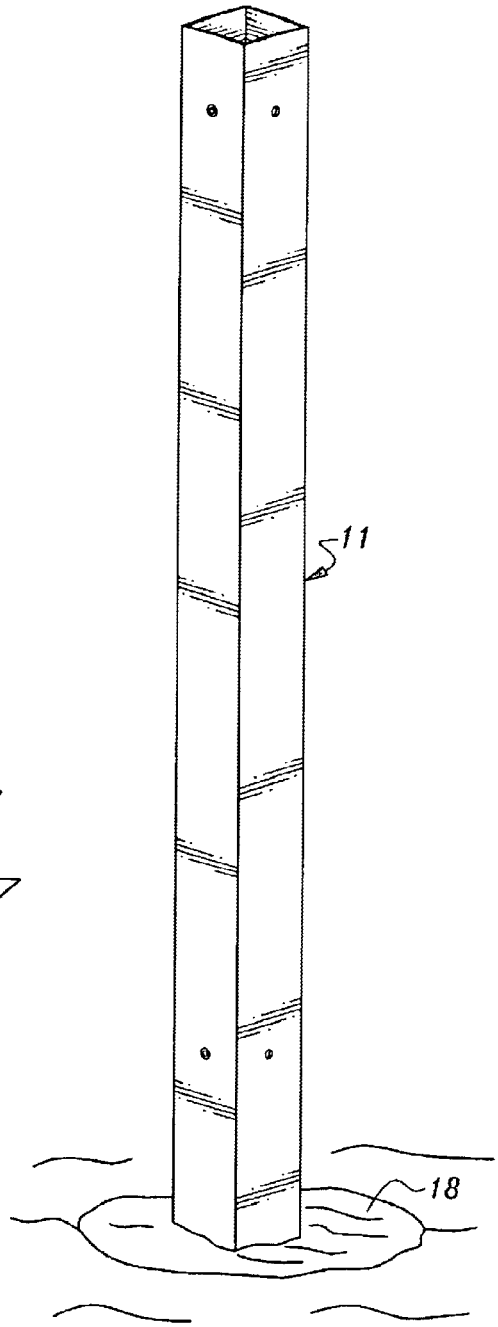
FIG. 10 is a diagrammatic view later in time showing the pole set in a hole with the insert disposed thereon and not visible.

The insert 21 is placed in a generally vertical disposition and the post is dropped there over; the exact elevation of the location of the top this pole relative to all others is determined by one "eyeballing it," or by using a chalk line 38 [per FIG. 9] from the two adjacent posts on opposite sides thereof or by careful measurement, this and other techniques for correct pole disposition are well within the knowledge of those skilled in the art.

Once the proper elevation of the pole is determined relative to the others, and the pole temporarily held in place by a worker, or restrained in place in some fashion, a bolt or other fastener 31 is disposed into and through the respective connector 20 in the lower bore 16 into the insert 21. See FIG. 9. The post 11 with the connected insert 21 therein are cemented into position according to the mode set forth in the method section of this application. See also FIG. 9. See the commentary infra as to factory pre-assembly.

Figure 13:
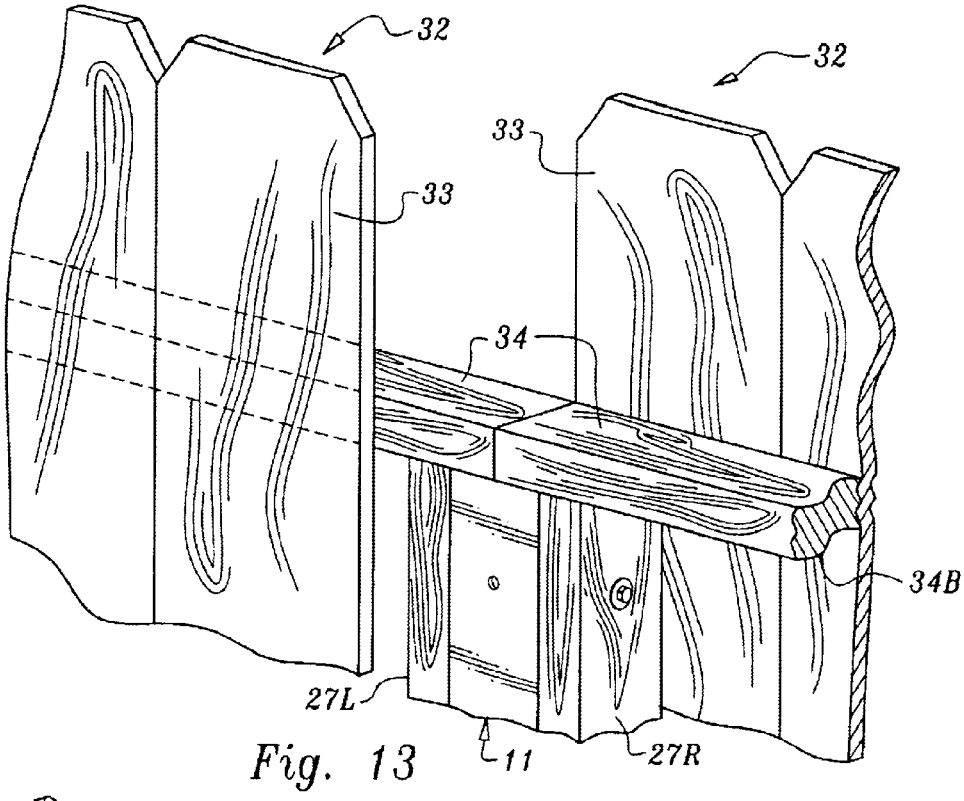
FIG. 13 is a perspective view of the junction of the upper cross member of two adjacent sections of "good neighbor" fence to the post system of this invention.

A pair of slab side members 27 are strategically sized to match the elevation between the bottom surface 34B of the upper cross member 34 and the bottom surface 36T of lower cross member 36. A pair of correctly sized slab side members is attached at a location on the pole that matches the elevation from the ground surface 67 of the two faces 36B and 36T. See FIGS. 11, 13 , and 14.

These slab side members 27 are bolted to two faces of the post 11. See FIG. 11. Placement as just described of the slab side member 27 permit a fencing section 32 to have its surface 36T abut the bottom edge of the slab side member 27 and surface 34B abut the top edge of the side member such that the fence section 32 hangs on one side member 27 of the post 11. See infra with respect to the discussion pertaining to FIG. 14. The fence section 32's two cross members can be "toenailed," a term known to the art to the slab side members for ultimate disposition of the fence section 32.

The discussion and drawings show the disposition of two slab side members on opposite faces of a pole, it should be understood, that the pole can hold up four slab side members, one on each face. The standard situation calls for two such members when a post is being positioned between existing linear sections of fencing. But of course, not all fencing is strictly linear. At a corner intersection, the pole would have two slab side members 27 each mounted normal to the other at 90 degrees rather than at 180 degrees as with linear fencing. For a Tee intersection, slab side members would be mounted on three faces of the pole. Should an X intersection be required as at the boundary of four abutting properties, at a single plot point, the pole would have all four faces bearing slab side members. While not illustrated specifically, the attachment of additional slab side members to a pole in a number greater than two is easily understood.

While the discussion has indicated that the slab side members 27 are added after the pole 11 has been cemented into position, it is also within the scope of the invention, to attach the slab side members to the pole before the pole is sunk into the concrete. Units pre-assembled at a factory, could be shipped with the slab side members 27 pre-attached in the same manner as discussed herein.

Figure 11:
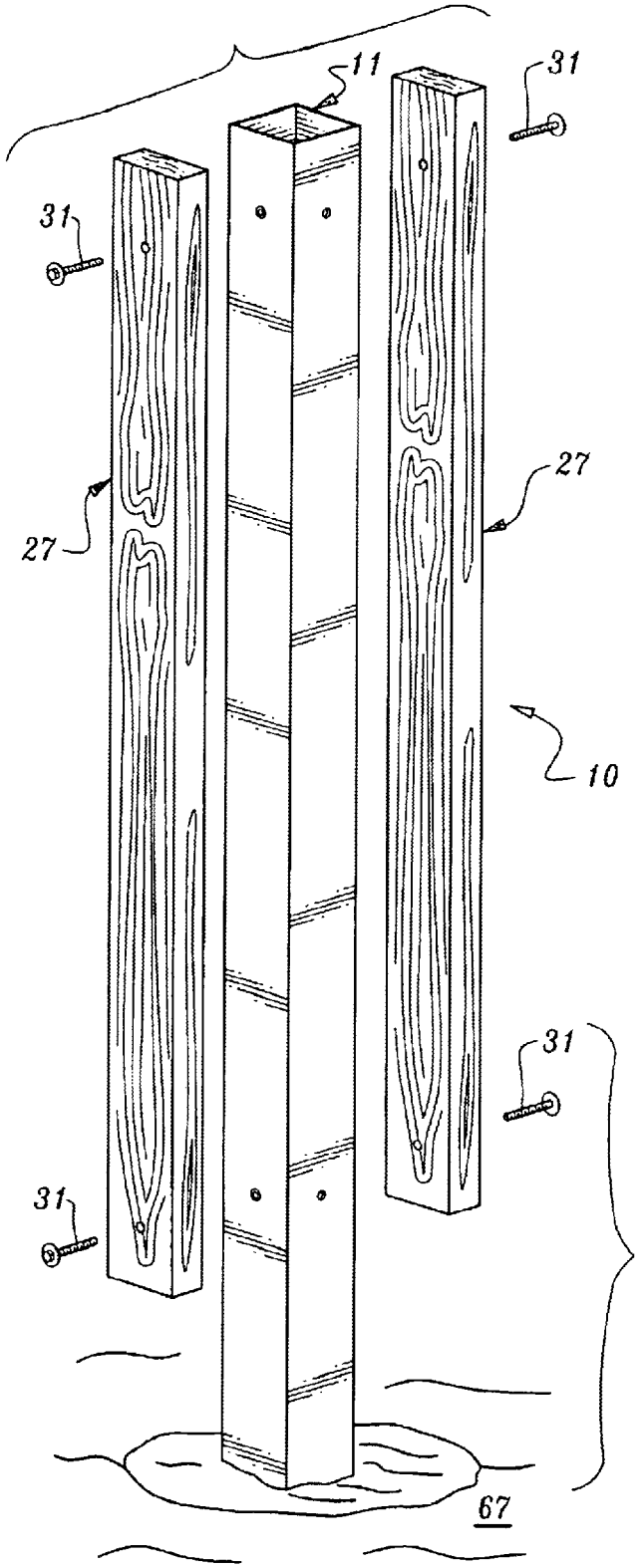
FIG. 11 is an exploded view showing a pair of side members about to be secured to the pole set in concrete to complete the post system.
Figure 14:
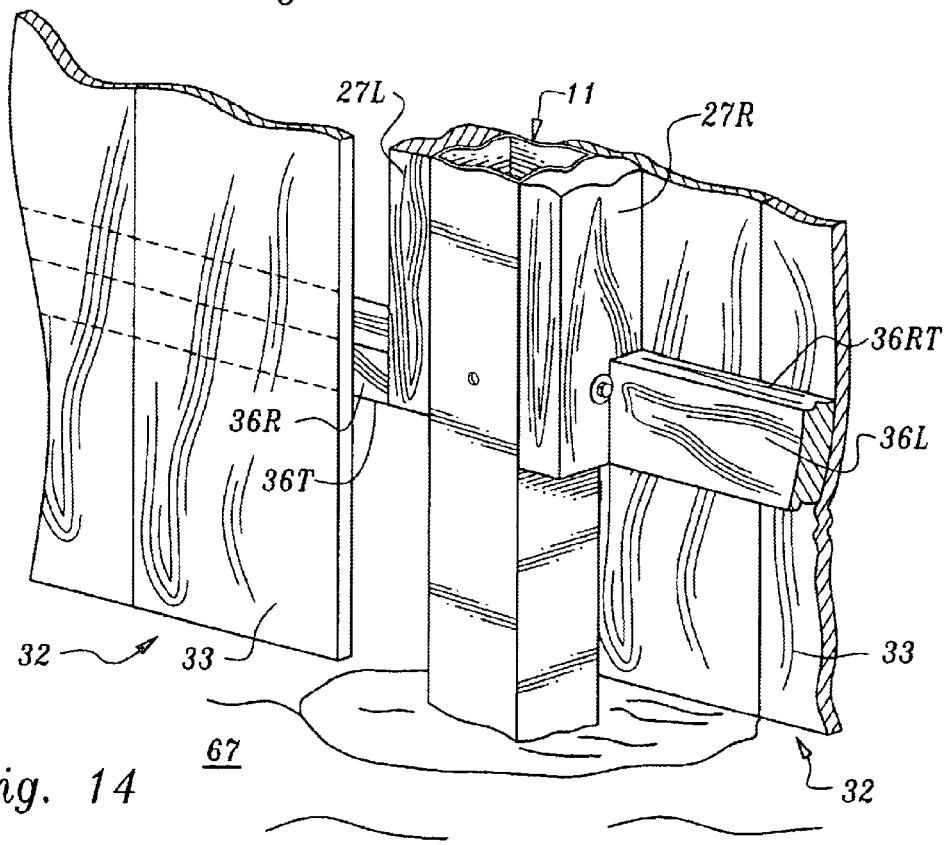
FIG. 14 is a diagrammatic view which illustrates two modes of conventional attachment of the lower cross member of each of two "non-good neighbor" fencing sections to their respective slab side member of a post system of this invention.

Since the construction of the fence section 32, nor the nature of the pickets, 4, 6, or 8 inches wide, dog-eared or not, and length of the cross members 34 and 36 form no part of the invention, the post system shown in FIG. 11 may be modified to be taller than that shown in FIG. 14, which depicts a typical California residential fence. Such a taller post system, would still have the cross members 34,36 of the fence section toenailed to the slab side members 27. Typically, taller post systems would be of an elevation that match the height of the pickets.

Figure 6:
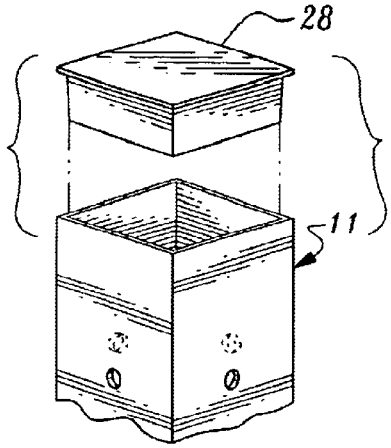
Fig. 6 (Prior Art)
FIG. 6 is a prior art post cap used with this invention.

A cap or post covers 28, such as shown in FIG. 6 can optionally be placed on top of the pole by friction fit or by pounding it in place with a mallet or a clenched fist, such prior art post covers are manufactured by T-PlasTech Corporation of Englewood, Colorado among others. Such caps 28 are known to the art, and are employed to keep the rain and snow and even animals and insects from gaining entrance to the tube. These are used more often with the taller posts where the upper cross member does not overlie both the pole and the slab side member.

It is important to understand that the post system under construction in this invention, has its pole which due to the presence of the part way inwardly disposed insert, may be retained spaced from the floor of the excavation, in a vertical position by guy wires or other means, in the same general manner any other post is temporarily retained in a generally vertical disposition prior to concrete hardening.

The next section of this application deals further with the process of repairing a fence or erecting a new fence using the post system of this invention.

In order to emphasize the relationship of this process to the prior art, it is to be recognized that the same amount of excavation of the concrete pour is required as would be for the installation of a typical redwood or pressure treated hemlock post. The big difference lies in the fact that the metal tubular pole based post system need not be cut with a saw of any type, as the elevation is determined at the time of bolting of the tube to the wood or other material insert. While it may be necessary to excavate a bit more to achieve proper elevation, it will not be necessary to shorten the tube, a difficult task for many home handy persons.

Method

Figure 7:
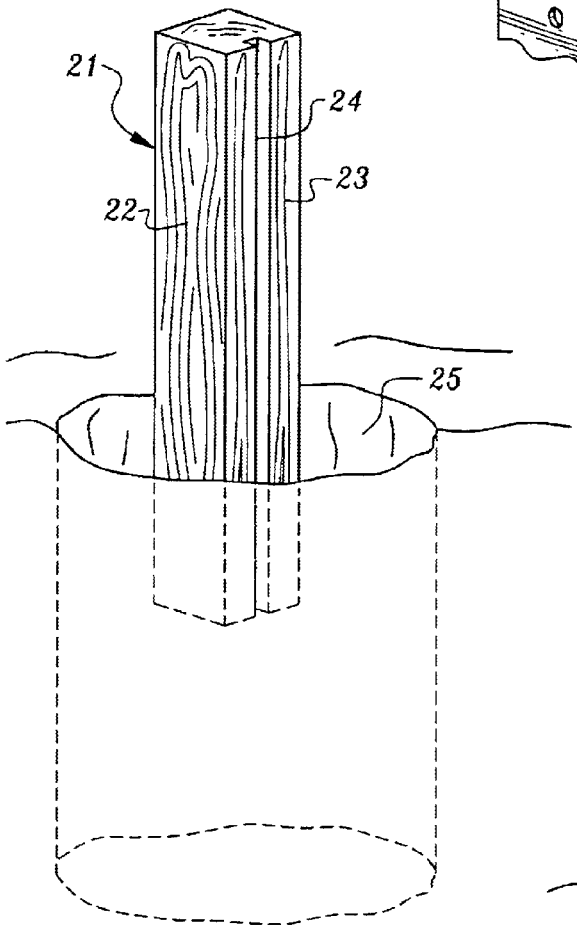
FIG. 7 is a diagrammatic view showing the insert disposed in an excavation.

The reader is urged to turn to FIG. 7 which depicts the insert correctly oriented such that the notch side 23 of the insert 21 aligns with the face of the pole which has the lower bore connector therein prior to bolting of the tube to the insert disposed therein through this connector. See FIG. 8. Care must be exercised to correctly determine the elevation of the top of the pole telescoped over the insert, prior to bolting and cementing. That is why in most instances, the pole is spaced a finite distance from the floor of the excavation where the insert sights when the attachment of the pole to the insert takes place.

The insert being wood or other wood fiber-based; material and relatively light in weight, need not be wired or staked to assume a true vertical position prior to the pouring of the concrete 18 into the excavated hole 25. Staking or guy wiring should not be done until after the insert is attached to the pole. And the pole is staked, not the insert 21. As the concrete 18 is added to the excavated hole 25, the staking wires, if used are to be aligned to ensure, the vertical disposition of the pole and to ensure further that the pole itself is set sufficiently deep into the concrete. The pole is leveled but is retained vertically by the insert. Once the pole is aligned in its placement with the previously disposed insert, the concrete is permitted to dry and harden to thereby retain the post in the concrete over the insert.

The next step is to set the plurality of upper and middle connectors into position using the special tool discussed supra, or in the case of other brands of connectors, perhaps by a common screwdriver. Once engaged into their respective bores, the side members 27 can be attached to the tubular pole using screws or bolts 31 sized to threadedly engage each respective connector of the respective upper and middle bore connector sets. See FIG. 11.

By limiting the elevation of the insert to a height significantly lower than the location of the middle bore set in the pole, all cross member attachment problems are avoided. A height of about 6 to 10 inches within the confines of the tube is suggested after insertion.

Side members 27, which can be 1 to 2 inches stock, are sized such as to be of slightly less in elevation than the two spaced cross members 34, 36 of fence section 32. By so doing, the side member 27 nests between the two cross members 34 to which the pickets 33 are attached. The cross members can then be toenailed to the side member or attached using conventional L-shaped bracing, not shown. It is seen that the fencing sections are usually attached in opposed directions, each normal to the point of connection of the tube to the insert. See FIGS. 8 and 11.

It is to be noted that if an instance arises, where the lower cross members of a particular fencing section to be attached, is disposed particularly low, relatively speaking, whereby attachment to a side member through the normally located middle bore cannot be achieved, extra effort is required. Such an instance is when the disposition of the lower cross member of that fencing section is at an elevation approaching the top of the insert disposed within the pole. An extra bore may be needed to be made in a face or faces of the pole, due to insufficient clearance for the presence of the unnotched sides of the hidden insert. Thus, it becomes necessary to use a double notched insert. See FIG. 12 where the double notch insert is designated 41, the unnotched sides 42, the notched out sides 43 and the notches themselves 44.

The same directions for the attachment of the fencing sections, still apply. Such a double notch insert is shown in FIG. 12. This insert can also be used when straight ahead access to the area between a worker and the old post is restricted.

Since the inserts are intended to be only 18 inches high with 6 inches thereof buried within the concrete, in most instances the attachment of the cross members will clear the elevation of the interiorly disposed insert of the post system, such that notches in the insert facing the direction of the attachment of a respective cross member may not be necessary.

FIG. 14 illustrates the two modes of attaching the lower cross member. Since two fence sections are involved with the post system shown in this figure, the right side lower cross member is designated 36R and the left side one 36L. Cross member 36R is sized and positioned on its respective fence section to have its top surface 36RT disposed such that the bottom surface of this cross member aligns horizontally with the bottom of slab side member 27R. On the left, however, cross member 36L has a greater lateral extension and fits beneath slab side member 27L. Both modes of construction are equally acceptable for ease of toenailing and durability of the junction.

In conclusion, by using a steel or aluminum alloy square tubing as the pole aspect of the new post of this invention, coupled with the mode recited above, fencing sections may be readily attached to metal posts. If the metal posts are painted, powder-coated, or galvanized, they will fully resemble their wooden brethren but will be much more durable.

For a final finishing touch, a conventional post covers 28 shown in FIG. 6 may be snap fit to the tubular metal post.

Figure 8:
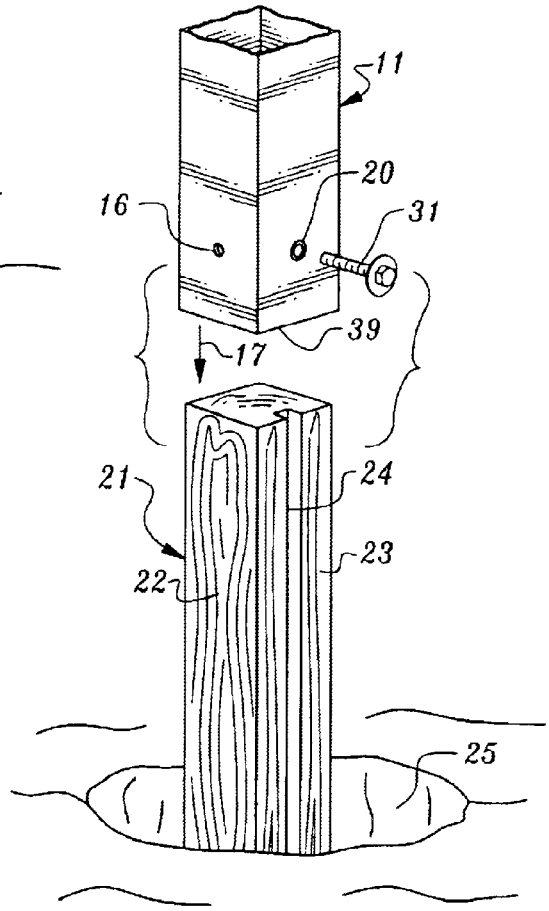
FIG. 8 is a diagrammatic view later in time showing the insert inset in a hole and the pole about to be lowered thereon, prior to concrete being added to the excavation.

While FIGS. 7 and 8 illustrate the placement of the insert into the excavation and then the pole over the insert with attachment through the bottom bore to follow, it is also within the scope of the invention, to pre-attach the insert to the pole, using the bolt and insert procedure described infra, either at the factory or on site, such that if the excavation is made precisely, no adjustment from the predetermined or preset height will be necessary. Such adjustment is achieved by merely loosening the bolt or screw slightly, and adjusting the elevation of the pole 11 relative to the insert 21 in the excavation, exact elevation can be achieved.

It is seen that I have devised a replacement product for worn or destroyed redwood or cedar fence posts, which can be similarly colored using today's technology to achieve a significantly more durable wind and weather resistant fence post.

The method taught herein permits conventional fencing sections, new or used, to be attached to the new fence posts of this invention.

While shown here as a 3 by 3-inch square tube, the pole per se could be sized and shaped differently, such as of rectangular or circular cross section since tubular members of such configurations are available in the marketplace.

While we have disclosed one brand of suitable connector for placement within the bores made in the tube, other brands of suitable connectors to allow releaseable connections to metallic tubular members can be employed.

While bolts have been disclosed as the primary mode of attaching fencing sections to the slab side members, suitable length deck or other screws may also be utilized. These are easily applied using a screwdriver tip in an electric drill.

As disclosed herein, the slab side members are attached as by bolting to the pole after the pole disposed over the insert is cemented into position. It is also within the scope of this invention, to attach the slab side members to the pole prior to the pole's disposition over and connection to the insert if such proves easier due to the presence of bushes for example.

For the typical California fence, where the post is not of the same elevation as the pickets, it has been found that good results can be obtained when the post is about 80 inches tall, the upper set of bores is at about 74 inches up from the base, the middle position bores are set at about the 38 inches point, and the lower bores are 1 inch above the base or bottom of the tube.

Since certain changes maybe made in the described apparatus without departing from the scope of the invention herein involved, it is intended that all matter contained in the above description and shown in the accompanying drawings shall be interpreted as illustrative and not in a limiting sense.

What is claimed is:

1. A post system for the attachment of fencing sections that comprises:

[a] a tubular metal pole having four right angles open at least at the bottom thereof, having three sets of through bores, an upper set, a middle set and a lower set, the upper and middle set of through bores comprising at least one bore in opposing directions, and at least one bore spaced uniformly between said opposed bores, the lower set of bores comprising at least one bore disposed in a direction between said opposed bores;

[b] each bore having a threaded connector disposed therein;

[c] a pair of slab side members, one each fastened to the upper and middle sets of threaded connectors disposed on two sides of the pole; and

[d] an elongated wood fibre based insert which in cross section has four right angles and having a vertical notch along one face thereof, disposed upwardly from the bottom and extending only partially into the pole and fastened to the pole's lower set of threaded connectors.

2. The post system of claim 1, wherein the pole is an elongated square tube, having four faces, and having the upper and middle sets of bores having connectors therein on at least three of the four faces.

3. The post system of claim 1, wherein the slab side members are selected from 1 by 4 inch and 2 by 4 inch wood fiber containing members.

4. The post system of claim 1, wherein the pole is an 80 inch tall square tube, and the upper bores are disposed approximately 4 to 6 inches from one end thereof, the middle bores are disposed about 38 inches from the second end thereof, and the third set of bores are disposed about 1 inch from the second end thereof.

5. A post system for the attachment of fencing sections that comprises:

[a] a square tube steel pole open at least at the bottom thereof, having three sets of through bores, an upper set, a middle set and a lower set; each of the upper and middle sets of through bores comprising at least one bore in at least two faces of the pole, the lower set of bores comprising at least one bore disposed in a direction between said opposed bores;

[b] each bore having a threaded connector disposed therein;

[c] wood slab side members, one each fastened to the upper and middle sets of threaded connectors disposed on at least two sides of the pole; and

[d] an elongated piece of wood insert having a square cross section and vertical notch along one face thereof, disposed upwardly from the bottom and extending only partially into the pole and fastened to the pole's lower set of threaded connectors.

6. The post system of claim 5, wherein the bores with connectors therein are both circumferentially spaced around the pole and vertically spaced between each set of bores.

7. A process for constructing a fence post system for the attachment of fencing sections which comprises:

[a] vertically disposing a notched elongated wood fiber containing member part way into the lower open end of a vertically disposed tubular pole, which pole has a trio of circumferentially spaced and vertically spaced sets of spaced bores therein, said bores having connectors disposed therein;

[b] fastening the insert to the pole; and

[c] attaching elongated slab side members vertically on the sides of the pole.

8. The process of claim 7, further including the steps of vertically disposing the insert into the bottom of an excavation, vertically orienting the now elevated pole with the insert therein, and cementing the pole and insert to form a stationary vertical post to which fence sections can be attached.

9. A process for constructing a fence post system for the attachment of fencing sections which comprises:

[a] providing a trio of spaced vertically, and spaced circumferentially, sets of bores in an open bottom elongated square tubular pole, which bores are designated upper, middle and lower bores;

[b] disposing within each of the plurality of bores a connector adapted to receive a bolt or screw;

[c] fastening an elongated slab side member on each of at least two of the opposite sides of the pole to the upper and middle connector bearing bores; and

[d] attaching a vertically disposed, a notched elongated, wood fiber containing insert part way into the open bottom end of said tubular pole, and attaching said insert to the lower connector containing bore set.

10. The process of claim 9, wherein the disposition of the insert is carried out prior to the fastening of the slab side members to the pole.

11. The process of claim 9, further including the step of cementing the pole and insert into a fixed vertical position.

12. The process of claim 10, further including the step of cementing the pole and insert into a fixed vertical position.

13. A post system for the attachment of fencing sections that comprises:

[a] a square tube steel pole open at least at the bottom thereof, having three sets of through bores, an upper set, a middle set and a lower set; each of the upper and middle sets of through bores comprising at least one bore in all four faces of the pole, the lower set of bores comprising at least one bore disposed in one face of the pole;

[b] each bore having a threaded connector disposed therein;

[c] slab side members, one each fastened to the upper and middle sets of threaded connectors disposed on at least two sides of the pole; and

[d] an enlongated piece of wood insert having a square cross section and vertical notch along one face thereof, disposed upwardly from the bottom and extending only partially into the pole and fastened to the pole's lower set of threaded connectors.

14. The post system of claim 13, wherein the slab side members are wood.

15. The post system of claim 14, wherein slab side members are fastened to at least three of the four faces of the pole.

16. The post system of claim 3, wherein each set of upper and middle bores is a single bore in each face of the pole.

17. A process for constructing a fence post system for the attachment of fencing sections which comprises:

[a] attaching a vertically disposed, a notched elongated, wood fiber containing insert part way into the open bottom end of an elongated tubular pole, and attaching said insert to said pole

[b] cementing the insert and the elevated pole into position in an excavation,

[c] providing a pair of spaced vertically, and spaced circumferentially, sets of bores in the elongated square tubular pole, which bores are designated upper, and middle bores;

[d] fastening an elongated slab side member on each of at least two of the opposite sides of the pole to the upper and middle connector bearing bores.

18. The process of claim 10, further including the step of attaching fencing sections to each of the slab side members.

19. The process of claim 16, further including the step of attaching fencing sections to each of the slab side members.

20. A pole for use in a post system for the attachment of fencing sections, which pole comprises:

[a] an elongated tubular member having four right angles open at least at the bottom thereof, having three sets of through bores, an upper set, a middle set and a lower set, the upper and middle set of through bores comprising at least one bore in opposing directions, and at least one bore spaced uniformly between said opposed bores, the lower set of bores comprising at least one bore disposed in a direction between said opposed bores;

[b] each bore having a threaded connector disposed therein;

[c] an insert of rectangular configuration disposed upwardly from the bottom and extending only partially into the pole and fastened to the pole's lower set of threaded connectors;

wherein the pole is a square tubular member of an elevation of about 80 inches tall, and the upper set of bores is at about 74 inches up from a first end of said pole, the middle position bores are at about the 38 inches from said first end, and the lower bores are 1 inch above the first end, which is the bottom of said pole;

and further wherein the insert disposed partially within said tubular member is an elongated wood fiber-based object having four faces and a full length notch recessed in one face, said insert being about 18 inches long.

21. A post system for the attachment of fencing sections that comprises:

square steel tubular pole open at both ends thereof, having three sets of through bores, an upper set, a middle set and a lower set, the upper and middle set of through bores comprising at least one bore in opposing directions, and at least one bore spaced uniformly between said opposed bores, the lower set of bores comprising at least one bore disposed in a direction between said opposed bores;

each bore having a threaded connector disposed therein;

pair of slab side members, one each fastened to the upper and middle sets of threaded connectors disposed on two opposite sides of the pole; and a square cross section wood fibre containing insert having a full-length, vertical notch on one face thereof, which in cross section has four right angles and having a vertical notch disposed upwardly from the bottom and extending only partially into the pole and fastened to the pole's lower set of threaded connectors.

* * * * *